US007289071B2

(12) United States Patent
Hung et al.

(10) Patent No.: US 7,289,071 B2
(45) Date of Patent: Oct. 30, 2007

(54) MULTI-FREQUENCY ANTENNA SUITABLY WORKING IN DIFFERENT WIRELESS NETWORKS

(75) Inventors: Chen-Ta Hung, Tu-Cheng (TW); Hsien-Sheng Tseng, Tu-Cheng (TW); Lung-Sheng Tai, Tu-Cheng (TW); Shu-Yean Wang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 7 days.

(21) Appl. No.: 11/201,463

(22) Filed: Aug. 11, 2005

(65) Prior Publication Data

US 2006/0262016 A1 Nov. 23, 2006

(30) Foreign Application Priority Data

May 23, 2005 (TW) ..... 94116677

(51) Int. Cl.
*H01Q 1/24* (2006.01)

(52) U.S. Cl. ..... 343/702; 343/846

(58) Field of Classification Search ..... 343/702, 343/700 MS, 846

See application file for complete search history.

(56) References Cited

U.S. PATENT DOCUMENTS 5,181,044 A 1/1993 Matsumoto
6,404,394 B1 6/2002 Hill
6,600,448 B2 7/2003 Ikegaya
6,724,348 B2 4/2004 Fang
6,812,892 B2 11/2004 Tai
6,861,986 B2 3/2005 Fang
6,891,504 B2 5/2005 Cheng
7,030,830 B2 * 4/2006 Azoulay et al. ..... 343/815
7,057,560 B2 * 6/2006 Erkocevic ..... 343/700 MS
7,119,747 B2 * 10/2006 Lin et al. ..... 343/702
7,136,025 B2 11/2006 Lin
7,161,543 B2 * 1/2007 Cheng et al. ..... 343/702
2004/0090378 A1 * 5/2004 Dai et al. ..... 343/700 MS
2004/0160370 A1 * 8/2004 Ghosh et al. ..... 343/702
2005/0093752 A1 5/2005 Cheng
2005/0104788 A1 5/2005 Hung
2005/0116865 A1 6/2005 Fang
2005/0190108 A1 9/2005 Lin
2006/0250309 A1 11/2006 Fang

* cited by examiner

*Primary Examiner*—Hoang V. Nguyen
(74) *Attorney, Agent, or Firm*—Wei Te Chun

(57) ABSTRACT

A multi-frequency antenna includes a first antenna (1) and a second antenna (2) both operating at wireless wide area network, a third antenna (3) and a fourth antenna (4) both operating at wireless local area network. The first antenna, the second antenna, the third antenna and the fourth antenna are integrally made from a metal sheet and have a common grounding portion (50). The first and the second antennas have a first connecting portion (12) on which a feeding point (120) is located, and the third and the fourth antenna have a second connecting portion (34) on which another feeding point (340) is located.

33 Claims, 5 Drawing Sheets

MULTI-FREQUENCY ANTENNA SUITABLY WORKING IN DIFFERENT WIRELESS NETWORKS

BACKGROUND OF THE INVENTION

1. Field of the Invention

The present invention relates generally to an antenna, and more particularly to a multi-frequency antenna for a wireless communication device.

2. Description of Prior Art

With the high-speed development of the mobile communication, people more and more expect to use a computer or other portable terminals to optionally connect to Internet. GPRS (General Packer Radio Service) and WLAN (Wireless Local Area Network) allow users to access data wirelessly over both cellular networks and 802.11b WLAN system. When operating in GPRS, the data transmitting speed is up to 30 Kbps~50 Kbps, while when connected to a WLAN access point, the data transmitting speed is up to 11 Mbps. People can select different PC cards and cooperate with the portable terminals such as the notebook computer and etc. to optionally connect to Internet. Since WLAN has a higher transmitting speed, WLAN is usually used to provide public WLAN high-speed data service in some hot areas (for example, hotel, airport, coffee bar, commerce heartland, conference heartland and etc.). When leaving from these hot areas, network connection is automatically switched to GPRS.

As it is known to all, an antenna plays an important role in wireless communication. As a result, the PC card may choose individual antennas to respectively operate at WWAN (Wireless Wide Area Network), namely GPRS, and WLAN. However, the two individual antennas will inevitably occupy more space than a single antenna in general. Hence, it is necessary to be concerned by researchers skilled in the art how to incorporate two antennas respectively operating at WWAN and WLAN into a single antenna.

SUMMARY OF THE INVENTION

An object of the present invention is to provide a multi-frequency antenna which can integrate the antenna for WWAN and the antenna for WLAN together, thereby reducing the installation space of the antenna and the antenna having the excellent performance.

To achieve the aforementioned object, the present invention provides a multi-frequency antenna comprises a first antenna and a second antenna both operating at wireless wide area network, a third antenna and a fourth antenna both operating at wireless local area network. The first antenna, the second antenna, the third antenna and the fourth antenna are integrally made from a metal sheet and have a common grounding portion. The first and the second antennas have a first connecting portion on which a feeding point is located, and the third and the fourth antenna have a second connecting portion on which another feeding point is located.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
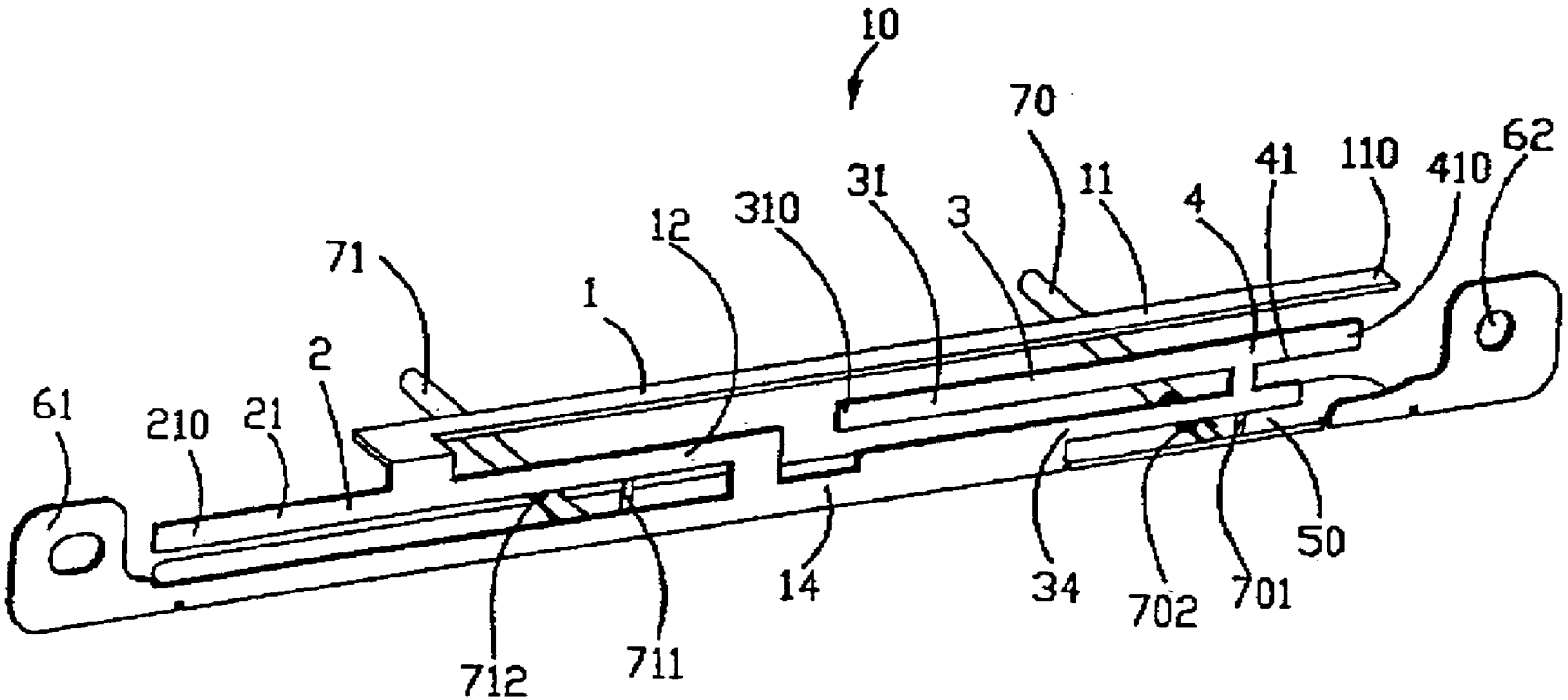
FIG. 1 is a perspective view of a multi-frequency antenna in accordance with a preferred embodiment of the present invention.
Figure 2:
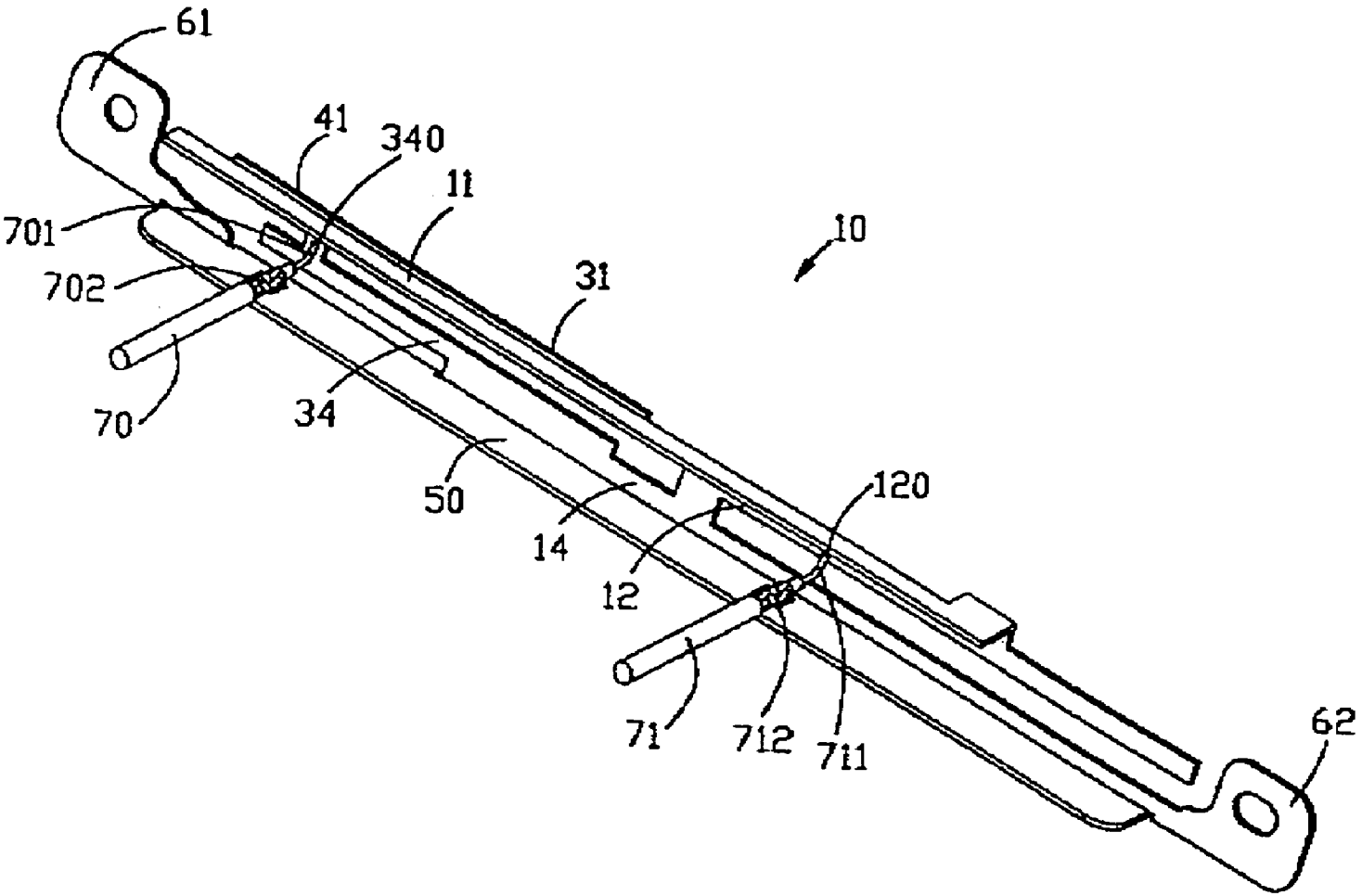
FIG. 2 is a view similar to FIG. 1, but from a different aspect.

Referring to FIGS. 1 and 2, a multi-frequency antenna 10 in accordance with a preferred embodiment of the present invention comprises a first type of antenna which is used in WWAN and has first and second antennas 1, 2, and a second type of antenna which is used in WLAN and has third and fourth antenna 3, 4. The multi-frequency antenna 10 is integrally made from a metal sheet and can integrate the first type of antenna for WWAN and the second type of antenna for WLAN together.

The multi-frequency antenna 10 has a first installing portion 61 and a second installing portion 62 at opposite ends thereof, which form an installing plane. The multi-frequency antenna to comprises a common grounding portion 50 for the first, the second, the third and the fourth antennas 1, 2, 3, 4. A lengthwise portion 14 extends perpendicularly and upwardly from the grounding portion 50, which is connected to the first installing portion 61 at one end thereof. The first antenna 1 and the second antenna 2 include a first connecting portion 12 extending upwardly from the lengthwise portion 14. The first antenna I comprises a first radiating element 11, which is coupled to the grounding portion 50 by the first connecting portion 12 and the lengthwise portion 14. The first radiating element 11 is designed in a tri-dimensional manner and extends in a lengthwise direction, thereby reducing the width of the installing plane in a traverse direction. A plane in which the first connecting portion 12 and the lengthwise portion 14 are located is defined as a first plane, a plane in which the first radiating element 11 is located is defined as a second plane, and a plane in which the grounding portion 50 is located is defined as a third plane. The first plane is respectively orthogonal to the second plane and the third plane, and the first plane and the installing plane are coplanar. The radiating element 11 of the first antenna 1 extends towards the second installing portion 62 in the first plane with a free end 110 thereof adjacent to the second installing portion 62. The central frequency the first antenna 1 operates at is about 900 MHz. The second antenna 2 comprises a second radiating element 21, which extends from the first connecting portion 12 towards the first installing portion 61 with a free end 210 thereof close to the installing portion 61. The central frequency the second antenna 2 operates at is about 1900 MHz. A feeding point 120 for the first antenna 1 and the second antenna 2 is located on the first connecting portion 12. The first and the second antennas 1, 2 are provided power by a coaxial cable 70 with an inner conductor 701 of the coaxial cable 70 welded to the feeding point 120 and an outer conductor 702 welded to the grounding portion 50. Both of the first antenna 1 and the second antenna 2 are inverted-F antennas.

The third antenna 3 comprises a third radiating element 31, and the fourth antenna 4 comprises a fourth radiating element 41. The third and the fourth antennas have a second connecting portion 34 connected to an end of the lengthwise portion 14. The third and fourth radiating element 31, 41 is connected to the grounding portion 50 by the second connecting portion 34 and the lengthwise portion 14, thereby forming two inverted-F antennas. The third and the fourth radiating element 31, 41 are arranged in a line and extend from an end of the second connecting portion 34 in opposite directions. The third radiating element 31 extends towards the first installing portion 61 and the fourth radiating element 41 extends towards the second installing portion 62. A feeding point 340 for the third antenna 3 and the fourth antenna 4 is located on the second connecting portion 34. Likewise, the third and the fourth antennas 3, 4 are provided power by a coaxial cable 71 with an inner conductor 711 of the coaxial cable 71 welded to the feeding point 340 and an outer conductor 712 welded to the grounding portion 50. The third antenna operates at the central frequency of 2.4 GHz and the fourth antenna operates at the central frequency of 5.2 GHz.

The first radiating element 11 of the first antenna 1 operating at WWAN and the third radiating element 31 of the third antenna 3 operating at WLAN are interlaced with each other so as to make the distance between the two free ends 110, 310 as far as possible for reducing the interference between the two antennas 1, 3. The interval between the central frequencies of the second antenna 2 and the third antenna 3 is smallest so that the interference between the two antennas can be produced easily. In the preferred embodiment, the space between the second antenna 2 and the third antenna 3 may make both of the antennas work perfectly. The second radiating element 21 of the second antenna 2, the third radiating element 31 of the third antenna, the fourth radiating element 41 of the fourth antenna 4, the first and second connecting portions 12, 34 and the lengthwise portion 14 are positioned on an identical planar, namely the first planar. The multi-frequency antennas of the preferred embodiment can be attached to two opposite sides in an upper end of the display of a computer, and can be fed power by feeding lines so as to make the multi-frequency antenna be employed at different wireless network cards.

Figure 3:
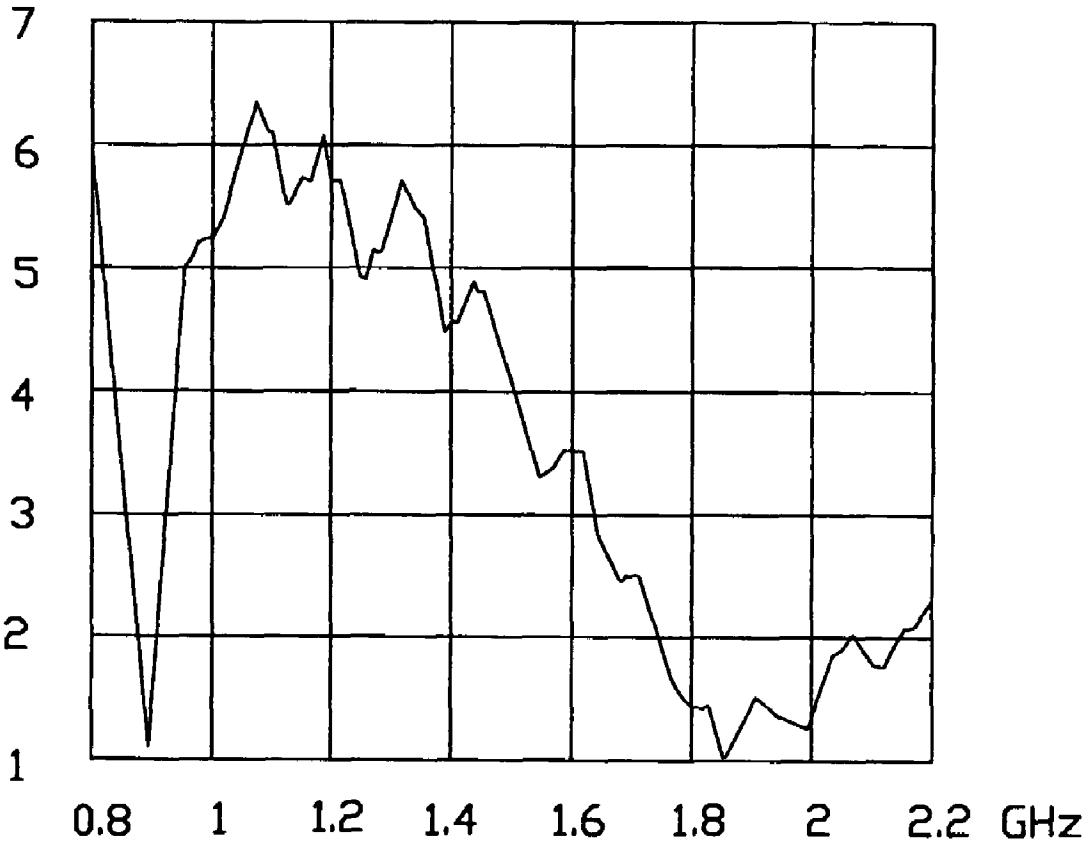
FIG. 3 is a test chart recording for the multi-frequency antenna of FIG. 1, showing Voltage Standing Wave Ratio (VSWR) as a function of WWAN frequency.
Figure 4:
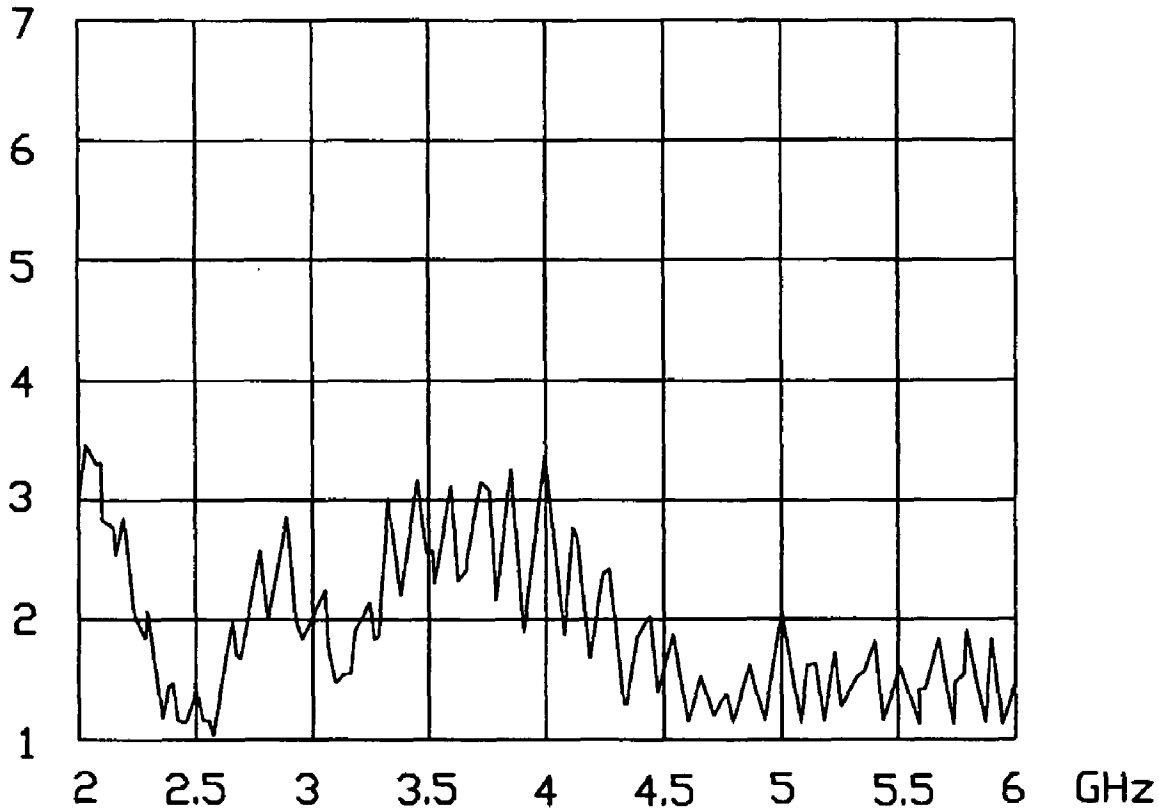
FIG. 4 is a test chart recording for the multi-frequency antenna of FIG. 1, showing Voltage Standing Wave Ratio (VSWR) as a function of WLAN frequency.
Figure 5:
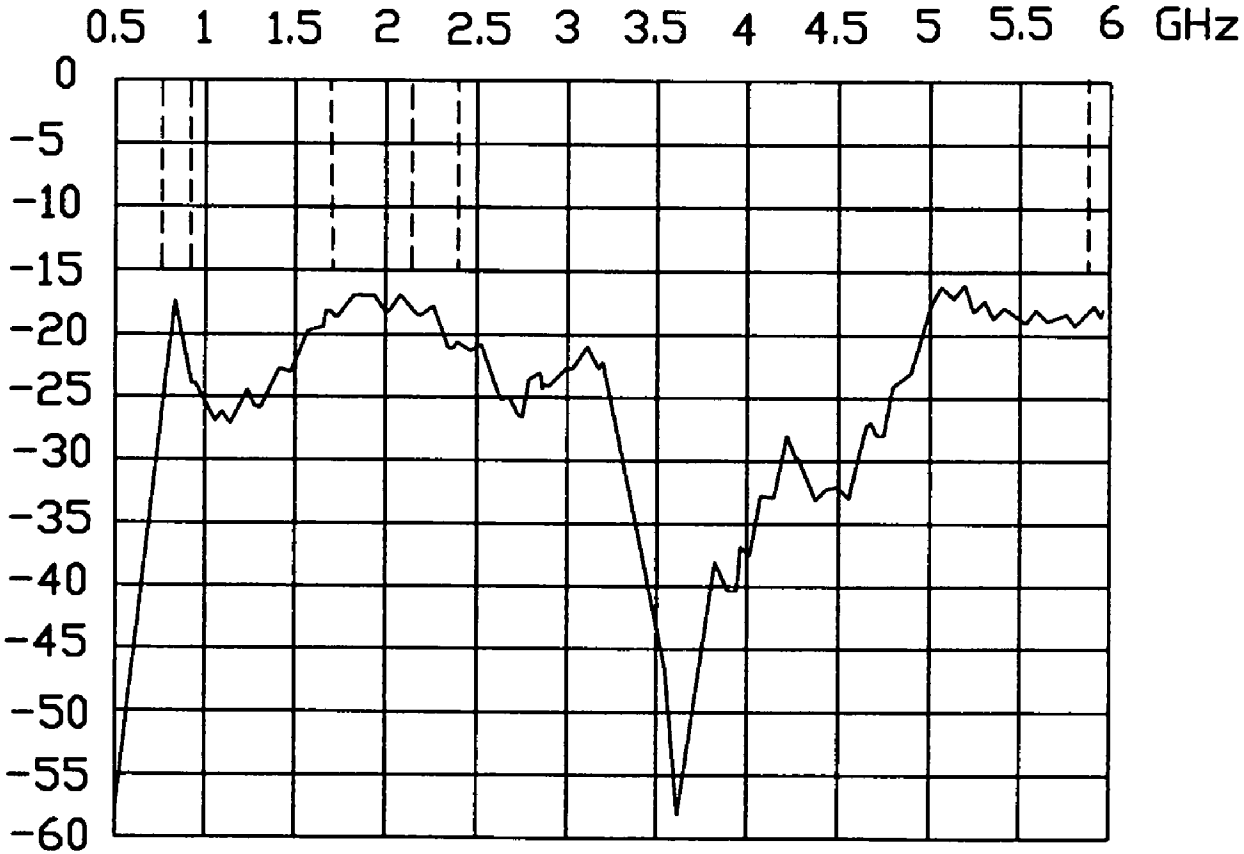
FIG. 5 is a test chart recording for the multi-frequency antenna of FIG. 1, showing isolation as a function of frequency.

FIG. 3 is a test chart of Voltage Standing Wave Ratio (VSWR) of the combined WWAN antennas, wherein x-coordinate defines frequency and y-coordinate defines VSWR. Likewise, FIG. 4 is a test chart of Voltage Standing Wave Ratio (VSWR) of the combined WLAN antennas, wherein x-coordinate defines frequency and y-coordinate defines VSWR. A perfect value of VSWR is 1 dB that is considered having best receiving quality. Generally speaking, VSWR under 2 dB is considered having good receiving quality. Under the definition of the VSWR less than 2 dB, it can be clearly seen from FIG. 3 that the values of the VSWR around 900 MHz and 1900 MHz can satisfy the definition as well as the values of the VSWR around 2.4 GHz and 5.2 GHz in FIG. 4 can satisfy the definition so that the efficiency for receiving the frequencies is excellent. FIG. 5 is a test chart of isolation of the multi-frequency antenna with x-coordinate defining frequency and y-coordinate defining isolation. It can be seen that the values of the isolation during the frequencies of WWAN and WLAN are less than −15 dB and can satisfy the requirement in practice.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-frequency antenna comprising:

a first type of antenna operating at wireless wide area network; and a second type of antenna operating at wireless local area network:

wherein said first type of antenna and said second type of antenna are integrally made from a metal sheet; wherein said first type of antenna and said second type of antenna are Inverted-F Antennas.

2. The multi-frequency antenna as claimed in claim 1, wherein said first type of antenna includes first and second radiating elements and accordingly forms first and second antennas.

3. The multi-frequency antenna as claimed in claim 2, wherein said second type of antenna includes third and fourth radiating elements and accordingly forms third and fourth antennas.

4. The multi-frequency antenna as claimed in claim 3, wherein said first antenna operates at the central frequency of 900 MHz and said second antenna operates at the central frequency of 1900 MHz.

5. The multi-frequency antenna as claimed in claim 3, wherein said third antenna operates at the central frequency of 2.4 GHz and said fourth antenna operates at the central frequency of 5.2 GHz.

6. The multi-frequency antenna as claimed in claim 3, wherein said first type of antenna has a feeding point for providing power to said first and said second antennas, and said second type of antenna has another feeding point for providing power to said third and said fourth antennas.

7. The multi-frequency antenna as claimed in claim 3, wherein said first radiating element and said third radiating element extend in opposite direction.

8. The multi-frequency antenna as claimed in claim 3, wherein said second radiating element and said fourth radiating element extend in opposite direction.

9. The multi-frequency antenna as claimed in claim 3, wherein said second, said third and said fourth radiating elements are arranged in a first plane.

10. The multi-frequency antenna as claimed in claim 9, wherein said first radiating element is arranged in a second plane orthogonal to said first plane.

11. The multi-frequency antenna as claimed in claim 10, further comprising a common grounding portion for said first and said second types of antennas, which is arranged in a third plane orthogonal to said first plane.

12. A multi-frequency antenna comprising:

a first antenna sub-assembly essentially extending along a longitudinal direction;

a second antenna sub-assembly essentially extending along said longitudinal direction; and both said first antenna sub-assembly and said second antenna sub-assembly sharing with and extending from different sites of same grounding area; wherein the first antenna sub-assembly includes a first radiating section extending along said longitudinal direction, the second antenna sub-assembly includes a second radiating section extending along said longitudinal direction under a condition that the second radiating section is shorter than the first radiation section and the second radiating section is generally located between the grounding area and the first radiating section in a direction perpendicular to said longitudinal direction; and wherein the second radiating section comprises two radiating elements extending in opposite directions.

13. The multi-frequency antenna as claimed in claim 12, wherein the first radiating section essentially extends in a first plane which is perpendicular to a second plane in which the second radiating section extends.

14. The multi-frequency antenna as claimed in claim 13, wherein a top edge of said second radiating section is substantially flush with said first plane.

15. The multi-frequency antenna as claimed in claim 12, wherein the first radiating section fully covers said second radiating section in said longitudinal direction.

16. The multi-frequency antenna as claimed in claim 12, wherein the grounding area is coplanar with the second radiating section.

17. A multi-frequency antenna comprising:

a grounding area;

a first lying L-shaped extension including a first short side extending from said grounding area, and a first long side extending from a distal end of said short side; and a second lying L-shaped extension including a second short side extending from a middle portion of the first long side, and a second long side extending from a distal end of the second short side; wherein an outer region between the distal end of the first long side and a joint point of said first and second L-shaped extension performs a first radiating function, and the second L-shaped extension performs a second radiating function; said first L-shaped extension and said second L-shaped extension direct toward opposite directions.

18. The multi-frequency antenna as claimed in claim 17, wherein most portions of said second L-shaped extension extends in a first plane perpendicular to a second plane in which said first L-shaped extension extends.

19. The multi-frequency antenna as claimed in claim 17, wherein said second long side is longer than the first long side.

20. A multi-frequency antenna suitably working in different wireless networks, comprising:

a ground element:

a first antenna including a first radiating element connected to the ground element with a first interconnecting element for radioactively communicate with a first wireless network working in a first radio frequency;

a second antenna including a second radiating element connected to the ground element with a second interconnecting element for radioactively communicate with a second wireless network working in a second radio frequency; and at least a positioning device arranged on the ground element.

21. The multi-frequency antenna as claimed in claim 20, wherein said first type of antenna includes first and second radiating elements and accordingly forms first and second antennas.

22. The multi-frequency antenna as claimed in claim 21, wherein said second type of antenna includes third and fourth radiating elements and accordingly forms third and fourth antennas.

23. The multi-frequency antenna as claimed in claim 22, wherein said first type of antenna has a feeding point for providing power to said first and said second antennas, and said second type of antenna has another feeding point for providing power to said third and said fourth antennas.

24. The multi-frequency antenna as claimed in claim 22, wherein said first radiating element and said third radiating element extend in opposite direction.

25. The multi-frequency antenna as claimed in claim 22, wherein said second radiating element and said fourth radiating element extend in opposite direction.

26. The multi-frequency antenna as claimed in claim 22, wherein said second, said third and said fourth radiating elements are arranged in a first plane.

27. The multi-frequency antenna as claimed in claim 26, wherein said first radiating element is arranged in a second plane orthogonal to said first plane.

28. The multi-frequency antenna as claimed in claim 27, further comprising a common grounding portion for said first and said second types of antennas, which is arranged in a third plane orthogonal to said first plane.

29. A multi-frequency antenna suitably working in different wireless networks, comprising a first ground plane arranged horizontally;

a second ground plane extending along art edge of the first ground plane, and dividing into a first section and a second section;

a first antenna including a first radiating element connected to the first section of the second ground element with a first interconnecting element for radioactively communicate with a first wireless network working in a first radio frequency;

a second antenna including a second radiating element connected to the second section of the second ground element with a second interconnecting element for radioactively communicate with a second wireless network working in a second radio frequency; and at least a first positioning device arranged on at least one of first ground plane and the second ground plane.

30. The multi-frequency antenna as recited in claim 29, wherein the first interconnecting element includes a first part extending parallel with respect to the first ground plane.

31. The multi-frequency antenna as recited in claim 29, wherein the second interconnecting element includes a second part extending vertically with respect to the first ground plane.

32. The multi-frequency antenna as recited in claim 29, wherein the first positioning device is arranged on the first wound plane.

33. The multi-frequency antenna as recited in claim 32, further including a second positioning device arranged on the second ground plane.

* * * * *